US011779073B2

(12) United States Patent
Nunez

(10) Patent No.: US 11,779,073 B2
(45) Date of Patent: Oct. 10, 2023

(54) BELT BAR

(71) Applicant: Swale Rahsaan Nunez, Brooklyn, NY (US)

(72) Inventor: Swale Rahsaan Nunez, Brooklyn, NY (US)

( * ) Notice: Subject to any disclaimer, the term of this patent is extended or adjusted under 35 U.S.C. 154(b) by 201 days.

(21) Appl. No.: 17/213,629

(22) Filed: Mar. 26, 2021

(65) Prior Publication Data

US 2021/0212400 A1 Jul. 15, 2021

(51) Int. Cl.
*A41F 9/00* (2006.01)
*A41F 9/02* (2006.01)

(52) U.S. Cl.
CPC ..... *A41F 9/007* (2013.01); *A41F 9/025* (2013.01)

(58) Field of Classification Search
CPC ..... A41F 9/007; A41F 9/025; B65D 63/109; Y10T 24/1408; Y10T 24/4047
See application file for complete search history.

(56) References Cited

U.S. PATENT DOCUMENTS 5,367,752 A * 11/1994 Petty ..... B65D 63/109 24/301
5,920,964 A * 7/1999 Malzahn ..... A41F 9/002 24/442
6,142,348 A * 11/2000 Park ..... A44B 11/005 224/183
6,230,878 B1 * 5/2001 Lehr ..... A45C 11/182 206/37
D527,898 S * 9/2006 Tavone ..... D3/247
7,765,620 B2 * 8/2010 Belouin ..... A44B 6/00 2/337
2004/0103500 A1 * 6/2004 Ward ..... B65D 63/109 24/17 B
2004/0172789 A1 * 9/2004 Lehr ..... B65D 63/109 24/17 AP
2007/0011850 A1 * 1/2007 Downing ..... A41F 9/007 24/16 R
2007/0033698 A1 * 2/2007 Long ..... A41F 9/007 2/94
2010/0162468 A1 * 7/2010 Hanson ..... A41F 9/002 2/338
2013/0340145 A1 * 12/2013 Cooper ..... A41F 9/002 2/312
2014/0310855 A1 * 10/2014 Clifton, Jr. ..... F41C 33/046 2/338

* cited by examiner

*Primary Examiner* — Robert Sandy
*Assistant Examiner* — Louis A Mercado

(57) ABSTRACT

A belt bar includes a multi-sided enclosure which sides form a center gap, the sides can be extended and expand and contract to modify the size of said gap, allowing the belt bar to adjust to the width and thickness of varying size belts being passed through the gap. The sides have an inside cavity space that house elastic objects attached to panels that allow for the expansion and retraction of the belt bar.

2 Claims, 3 Drawing Sheets

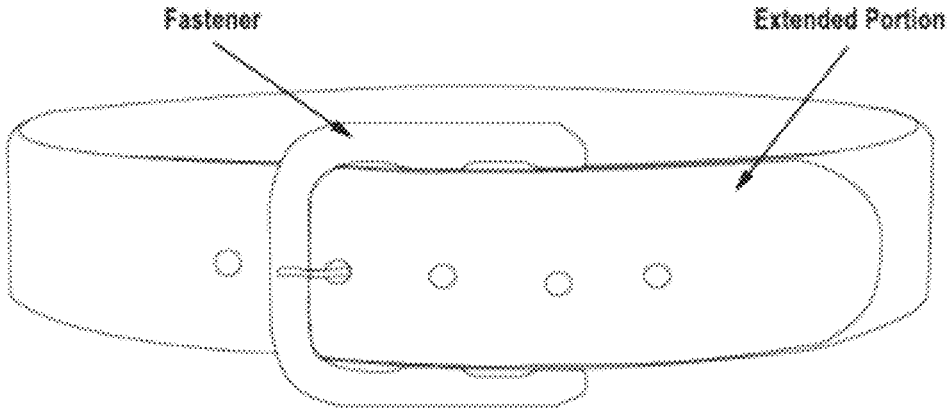
FIG. 1
FIG. 2A
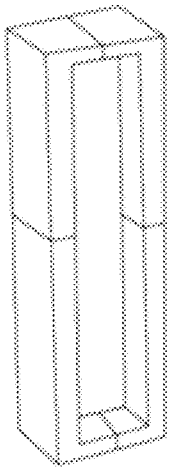
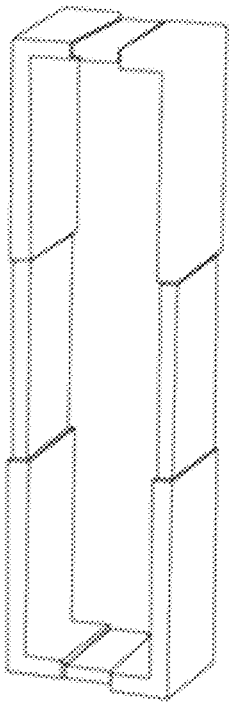
FIG. 2B
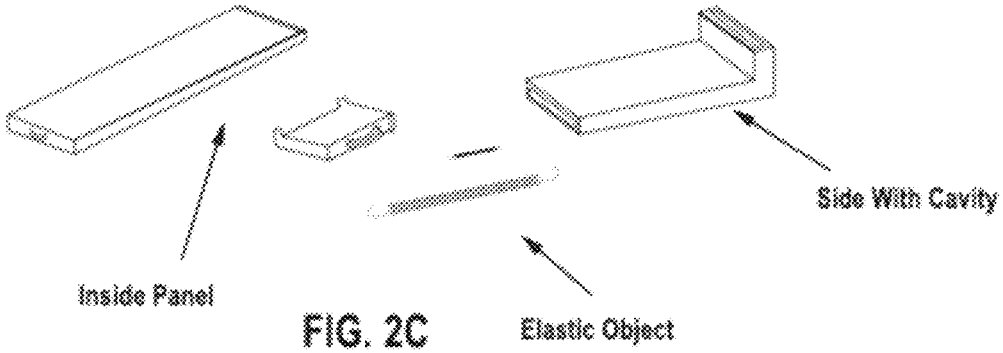
FIG. 2C

BELT BAR

TECHNICAL FIELD

This disclosure relates to apparel, and more particularly, to accessories to secure elements of clothing.

BACKGROUND

Belts are used to secure pants around the waist of a user. In a common implementation, a belt includes a length of flexible material and a fastener at one end of the length. A user wraps the belt over his pants, tightens the belt around his waist, and secures the other end of the length into the fastener. When properly tightened, the belt secures the pants against the user's waist.

DESCRIPTION OF DRAWINGS

FIG. 1 shows a belt.

FIG. 2A shows a belt bar closed with center gap

FIG. 2B shows a belt bar fully expanded with center gap

FIG. 2C shows the internal panels, elastic objects and sides with cavity

DETAILED DESCRIPTION

As shown in FIG. 1, due to differences between a user's waist size and the length of a belt, when the belt is secured against the user's waist, a portion of the belt length may extend beyond the fastener. This portion may differ in length depending on the difference between the user's waist size and the length of the belt. For example, a belt that is significantly longer than the user's waist will result in a lengthier extended portion, compared to that of a comparatively smaller belt.

The extended portion of the belt can be secured against the user's waist using a belt bar. An example belt bar is illustrated in FIGS. 2A and 2B, showing a contracted view and an expanded view of a belt bar, respectively. A belt bar comprises of a multi-sided enclosure which sides form a center gap, the sides can be extended and expand and contract to modify the size of said gap, allowing the belt bar to adjust to the width and thickness of varying size belts when being passed through the gap. The sides have an inside cavity space that house elastic objects attached to panels that allow for the expansion and retraction of the belt bar as illustrated in FIG. 2C.

Figure 3:
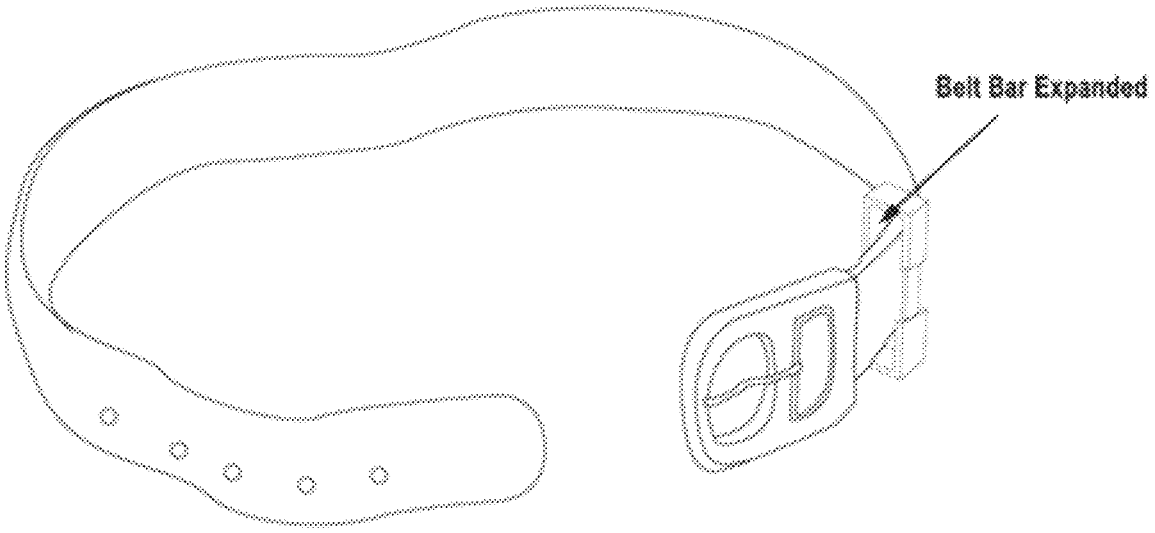
FIG. 3 shows an example usage of an expanded belt bar and unfastened belt
Figure 4:
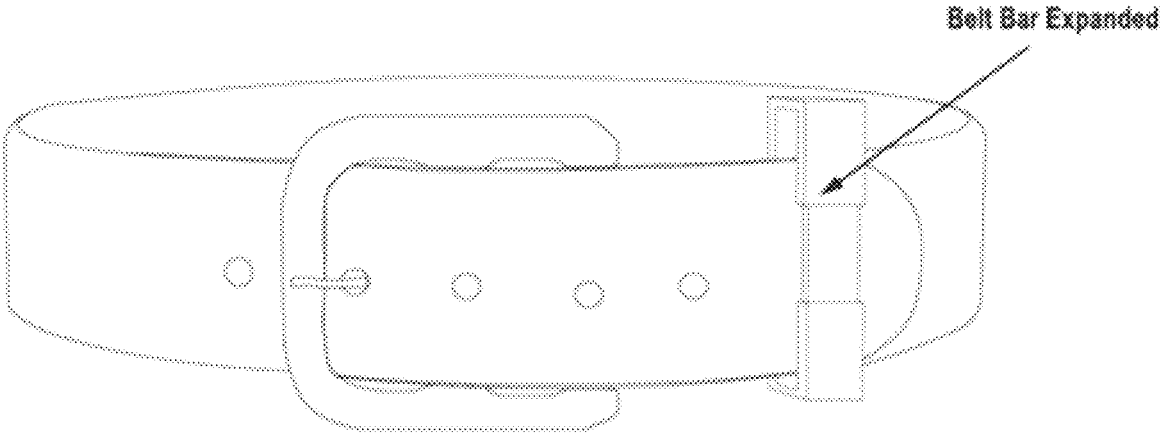
FIG. 4 shows an example usage of an expanded belt bar and fastened belt
Figure 5:
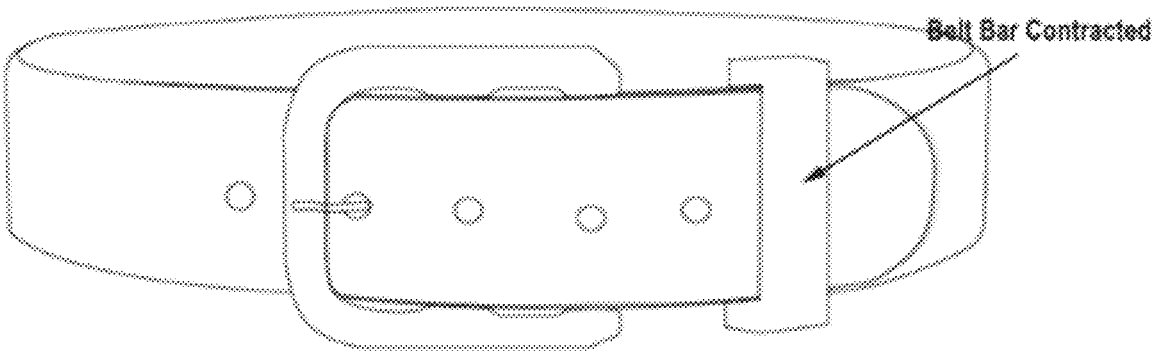
FIG. 5 shows an example usage of a contracted belt bar and fastened belt
Figure 6:
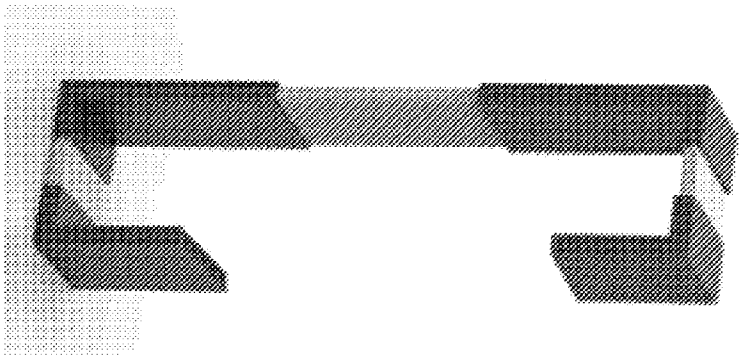
FIG. 6 shows a belt bar fully expanded with center gap and an open side

Referring to FIG. 5, the belt bar may be secured to the belt, such that the extended portion is forced against the rest of the belt. For example, the non-fastener side of the belt will slide through the gap of the belt bar and towards the fastener as illustrated in FIG. 3, the belt is then fastened, then the portion of the belt that extends beyond the fastener inserted into the remaining adjustable gap of the belt bar as illustrated in FIG. 4. In this position, the belt bar prevents the extended portion from freely extending from the fastener. This may provide various benefits. For instance, when the extended portion is forced against the rest of the belt, the belt may be less likely to become unfastened. The belt may also look more aesthetically pleasing in this arrangement, as it may visually appear to be a better fit for the user. It will also be more comfortable, as it is less likely to contact foreign objects as the wearer moves about.

In this manner, a belt bar can be used to secure an extended portion of a belt in order to provide security and/or aesthetic improvements to existing belts. The expand and contract functionality of the belt bar allows it to adjust to various sizes of existing belts.

An example belt bar has been illustrated and described. Nevertheless, it will be understood that various modifications may be made without departing from the spirit and scope of the invention. For example, each of the sides may vary in width, and can be thicker, approximately equal, or thinner in width compared to its extension.

In some implementations, the center gap may vary in size. For example, the width of the gap may be increased or decreased, such that the sides are either further part or closer together, respectively.

In other implementations, the number of sides can be greater, equal or less than the example illustrated and may or may not fully enclose the center gap. The varying number of sides will therefore affect the overall shape of the device and the center gap. For example, it may have 3 sides resembling a C shape and the sides can expand to hook onto a belt that the user may already be on the user's waist.

In other implementations, the sides may be fixed, without any internal panels, elastic objects or mechanism to support an adjustable center gap.

As illustrated in FIGS. 2A and 2B, the opposing sides expand in parallel. In some implementations, the angle of the sides with respect to each other may be increased or decreased, such that they extend towards each other to different degrees. The angle of the sides may be varied, for instance, in order to provide belt bars with firmer or looser grips.

As illustrated in FIGS. 2A and 2B, the sides are straight. In some implementations, the sides may be contoured with respect to each and reconfigure the shape of the center gap. The shape of the center gap may be varied, for instance, in order to provide a bespoke fit for nontraditional belt shapes.

As illustrated in FIG. 2C, the internal panels each include a lip on both sides of each end. In some implementations, the lip may be present on only one or on none of the panels ends. The lipped ends prevent the panels from popping out of the inside cavities.

The belt bar may be secured to the belt in various ways. For instance, fully expanded to allow for larger belts, in some implementations, unextend in its normal state, if the belt is the same size or smaller than the central gap. In some implementations, the belt bar assumes a size at any point between fully expanded or fully contracted. The belt bar may be secured close to the fastener of the belt, or it may be secured closer to the end of the extended portion, or somewhere between.

The belt bar may be made of various materials. For instance, it may be made of wood, metal, plastic, glass, leather, other materials suitable for clothing accessories, or combinations of one or more materials. Materials may also include various steel alloys, aluminum or alloys comprising same, as well as precious metals (in whole or as a coating) such as gold, silver, and platinum. Similarly, the elastic object may be a spring, rubber, or combinations of one or more materials that provide a similar elastic functionality. Moreover, the belt bar need not be made of a single material, but may be made of multiple materials for aesthetic or functional reasons. For example, the sides, inside panels and elastic object can be made of different materials to take advantage of varying stress-strain properties of materials. The belt bar may vary in color, and may be of a single color or of two or more colors.

Accordingly, other embodiments are within the scope of the following claims.

Also attached as an Appendix are additional drawings of a belt bar in accordance with this disclosure

What is claimed is:

1. A belt bar device for securing a belt, comprising:

a multi-sided enclosure which includes extendible sides to create an adjustable center gap;

with each side containing a cavity that includes an elastic element attached to adjustable side panels that allow the belt bar device to expand and contract; and wherein the extendible sides allow for the adjustable center gap to create a custom fit for the belt and to secure a first portion of the belt against a second portion of the belt.

2. A belt bar device for securing a belt, comprising:

extendible sides to create an adjustable center gap;

each side containing a cavity that includes an elastic element attached to adjustable side panels that allow the belt bar device to expand and contract;

one of the extendible sides being an open side such that the belt bar device partially encloses the belt; and wherein the extendible sides allow for the adjustable center gap to create a custom fit for the belt and to secure a first portion of the belt against a second portion of the belt.

* * * * *